US005871406A

United States Patent [19]

Worrell

[11] Patent Number: 5,871,406

[45] Date of Patent: Feb. 16, 1999

[54] GOLF SWING TIMING PROCESS

[76] Inventor: W. Robert Worrell, 148 Interlachen Rd., Hopkins, Minn. 55343

[21] Appl. No.: 935,408

[22] Filed: Sep. 23, 1997

[51] Int. Cl.[6] ..... A63B 69/36

[52] U.S. Cl. ..... 473/221; 434/252

[58] Field of Search ..... 473/221, 222; 434/252, 224, 234

[56] References Cited

U.S. PATENT DOCUMENTS

| | | | |
|---|---|---|---|
| 3,822,547 | 7/1974 | Fujita . | |
| 4,699,379 | 10/1987 | Chateau et al. . | |
| 4,940,236 | 7/1990 | Allen | 473/223 |
| 5,040,790 | 8/1991 | Anthes et al. | 473/221 X |
| 5,124,960 | 6/1992 | Miller et al. . | |
| 5,632,688 | 5/1997 | Blaakman | 473/198 |
| 5,743,807 | 4/1998 | Bendo et al. | 473/234 |

*Primary Examiner*—George J. Marlo
*Attorney, Agent, or Firm*—Hugh D. Jaeger

[57] ABSTRACT

A programmable electronic golf swing timer worn on the wrist like a watch with an actuator button worn underneath a golf glove which will audibly alert the player at the optimal time the club should contact the ball. This electronic golf swing timer will assist the golfer in maintaining a uniform and consistent golf swing. The process of timing a golf swing with the watch-like assembly includes the steps of:

a. setting a swing time for a particular golf club from back swing to contact with a golf ball by pressing a club button followed by a time button followed by a set button located on the watch-like assembly;

b. pushing a club button located on the watch-like assembly representative of the golf club to be swung;

c. observing an LED display on the watch-like assembly indicating the golf club chosen and the swing time for the golf club;

d. activating a membrane switch positioned conveniently on a finger clip remote from the watch-like assembly to generate an electrical connection to indicate the start of the back swing;

e. transmitting said electrical connection via a lead wire to the watch-like assembly to initiate a timer; and, f. providing an audible beep from the watch-like assembly after the swing time has elapsed as notification that contact of the golf cub with the golf ball should ideally occur.

6 Claims, 3 Drawing Sheets

GOLF SWING TIMING PROCESS

CROSS REFERENCES TO CO-PENDING APPLICATIONS

None.

BACKGROUND OF THE INVENTION

1. Field of the Invention

The present invention is for an electronic golf swing timer, and more particularly, pertains to an electronic timer worn on the wrist, and includes a membrane switch which is worn on the thumb and is connected to the electronic timer by a small lead wire worn on the inside of a golf glove. The electronic golf swing timer is a self administered timing device used to maintain consistent golf swing timing from the start of the back swing to the time of contact with the golf ball. An audible signal is sent when the timer reaches a preset time programmed by the player which, if used effectively, will audibly signal the player at the exact time of impact. Otherwise, the signal will alert the player of an early or late swing. The electronic golf swing timer is easily programmable to meet each individual golfer's swing and each golf club used.

2. Description of the Prior Art

Other devices have been used for providing information regarding timing or acceleration motion of specific sporting activities. For example, U.S. Pat. No. 4,699,379 to Chateau et al. describes a wrist-worn device that detects the rate of acceleration for the motion of a bowler. A signal indicates if the bowling motion suggests too much acceleration or if it is too slow. The main teaching of Chateau et al. is the development of an accelerometer able to measure small changes in acceleration and convert them to an electrical signal. Miller et al., U.S. Pat. No. 5,124,960, discloses an event register device for counting events or items. The device is worn on the wrist with a remote transducer located on the user's finger to activate the event count. Its primary use is for a swimmer to count swimming laps. Another device shown in U.S. Pat. No. 3,822,547 to Fujita discloses a digital wristwatch with a timer function located on the housing. This device does not allow for precise timing of a specific sporting motion that requires both hands. Furthermore, it does not provide a means to set a predetermined and precise desired time for a sporting motion and then provide the means to evaluate the precise timing of the specific sporting motion.

The present invention provides a means for setting a precise time for a specific sporting motion and a method for determining if the sporting motion is performed with that precise time or requires adjustment.

SUMMARY OF THE INVENTION

The general purpose of the present invention is a programmable electronic golf swing timer to alert the player of the optimal swing time per club.

According to one embodiment of the present invention, there is provided a watch-like assembly, including a wrist band, a casing, a club button actuator, a time button actuator, a set button actuator, yardage selector buttons, a hinged button cover, a speaker, and a LCD display which displays club selection, the swing time, actual time, hole number and yardage. There is also provided a sensor assembly including a thumb clip and membrane switch which is connected to the watch-like assembly via a lead wire and an electrical connector.

One significant aspect and feature of the present invention is a watch-like assembly which is small and comfortable.

Another significant aspect and feature of the present invention is the membrane switch, thumb clip and lead wire which easily fits under the standard golf glove.

Still another significant aspect and feature of the present invention is an easy to read LCD display.

Yet another significant aspect and feature of the present invention is hinged cover to protect the setting buttons.

A further significant aspect and feature of the present invention is a clock on the same LCD display as the swing time data.

A still further significant aspect and feature of the present invention is the programmability which can be changed as the golfer's game evolves.

Having thus described embodiments of the present invention, it is the principal object of the present invention to provide an electronic device to maintain a uniform and consistent golf swing.

One object of the present invention is to provide an easily portable device to time a player's golf swing.

Another object of the present invention is to provide an easily worn start switch.

Yet another object of the present invention is to provide an easily programmable device.

Still another object of the present invention is to provide an audible signal to the player at the time of contact with the golf ball.

A further object of the present invention is to provide a yardage display for each golf club selected.

A still further object of the present invention is to provide a clock as to eliminate the need for two wrist worn devices.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
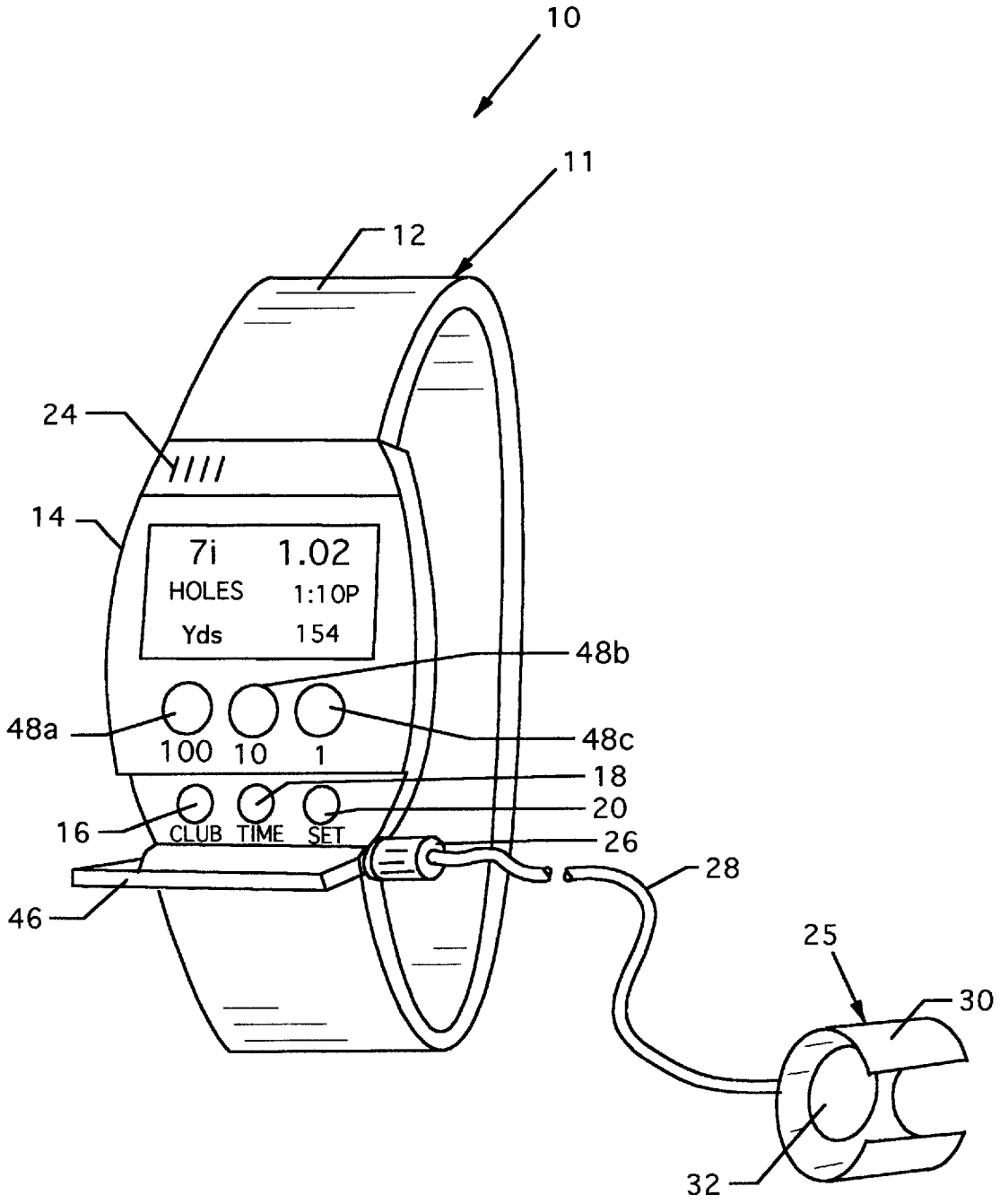
FIG. 1 illustrates a perspective view of an electronic golf swing timer, the present invention.

FIG. 1 illustrates a front perspective view of an electronic golf swing timer 10, the present invention. The electronic golf swing timer 10 is comprised of a watch-like assembly 11 having a wristband 12, a casing 14 having an LCD display 22, a speaker 24 and a plurality of push-button actuators including a club button actuator 16, a time button actuator 18, and a set button actuator 20 which are protected by a hinged button cover 46. Also provided are yardage selector buttons 48*a*–48*c*, a sensor assembly 25 having a thumb clip 30 having an attached membrane switch 32, a lead wire 28 with an electrical connector 26 on the opposite end. The electronic golf swing timer 10 is used to maintain a consistent golf swing by allowing the player to select the club the player wants to use by pressing the club button actuator 16, then allowing the player to set the timer by pressing the time button actuator 18 to the exact swing time the player best hits the golf shot, and then pressing the set button actuator 20 which locks that time in with connection to the club previously set. The process of setting the electronic golf swing timer 10 will require the player to take multiple shots at varied times in order to find the time to set the electronic golf swing timer 10 at the time the best shot is made with each club. The player then presses the yardage buttons 48*a*–48*c* to select the distance the best shot is hit, then presses the set button to lock that distance to the previously set time. This distance is displayed on a yardage display 38 of the LCD display 22. By setting the distance and timer, the player can select the proper club for each shot and tell the player the optimal swing time. The electronic golf swing timer 10 is initiated by the player at the beginning of the back swing by depressing the membrane switch 32 and the electronic golf swing timer 10 will audibly alert the player at the previously set time for the club the player has selected, which ideally will alert the player when the club first contacts the ball. If the player swings too fast, the electronic golf swing timer 10 will audibly alert the player after contact is made with the ball. If the player swings too slow, the electronic golf swing timer 10 will audibly alert the player before contact is made with the ball. The electronic golf swing timer 10 can be set for each club in the golfers bag with varied times for each club's optimal swing time. The features and operation of the electronic golf swing timer 10 will be further described in FIG. 2 and FIG. 3.

Figure 2:
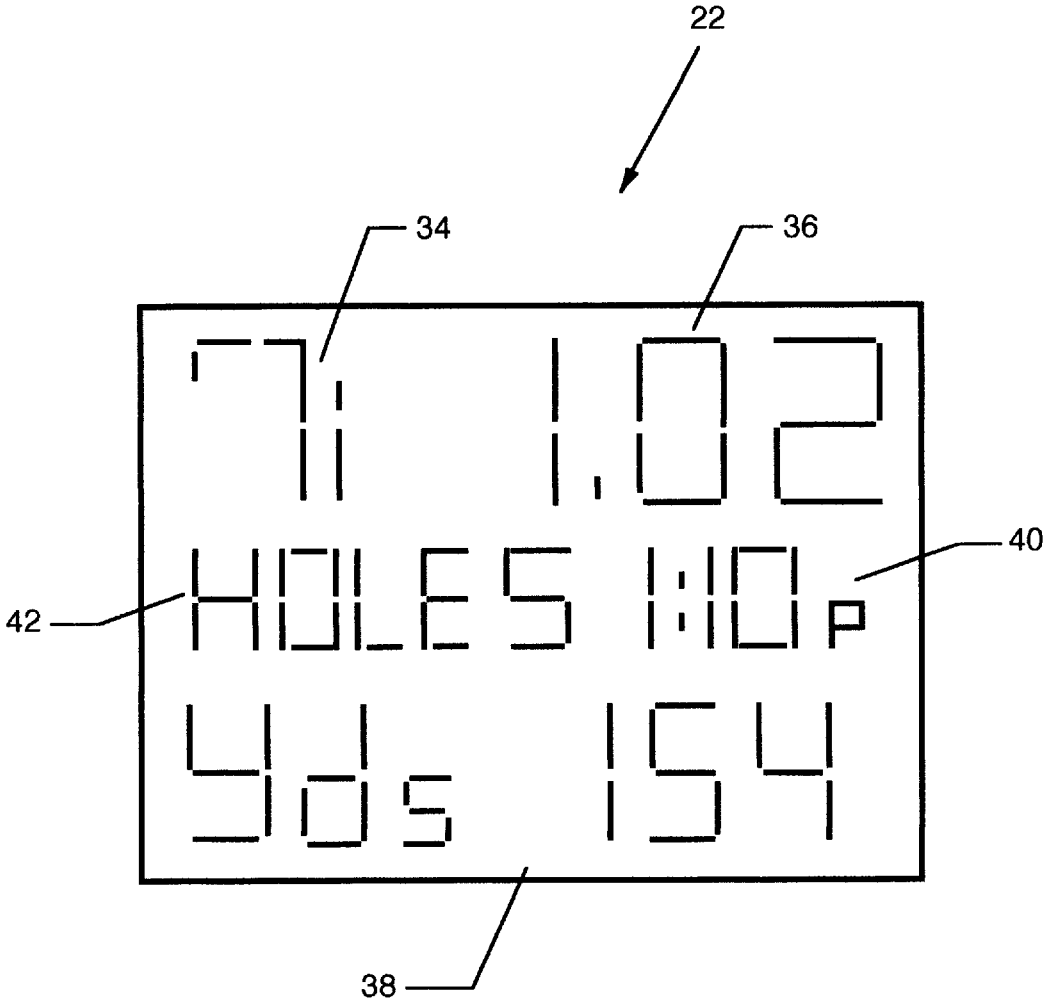
FIG. 2 illustrates a front view of the LCD display.

FIG. 2 illustrates a front view of the LCD display 22. Now described in detail are the features of the LCD display 22. The LCD display 22 features a club display 34, a timer display 36, a yardage display 38, a time display 40, and a hole number display 42. The club display 34, as shown in FIG. 2, shows a seven iron is selected, but this display will allow any club to be displayed. In this instance, the timer display 36 displays the swing time set by the player where the player best hits the ball with a seven iron. The time display 40 functions similar to displays in digital wrist watches. Additionally, a timer for those golf courses where the players are expected to play their round in a certain time is incorporated into the hole number display 42 which displays the hole number the player should be playing in order to finish in the allotted time. The amount of time the player should finish depends on course requirements and is set before the round by the player with the set button actuator 20 and calculates the total time divided by eighteen which averages the time per hole in order to keep the player at the course's pace.

MODE OF OPERATION

Figure 3:
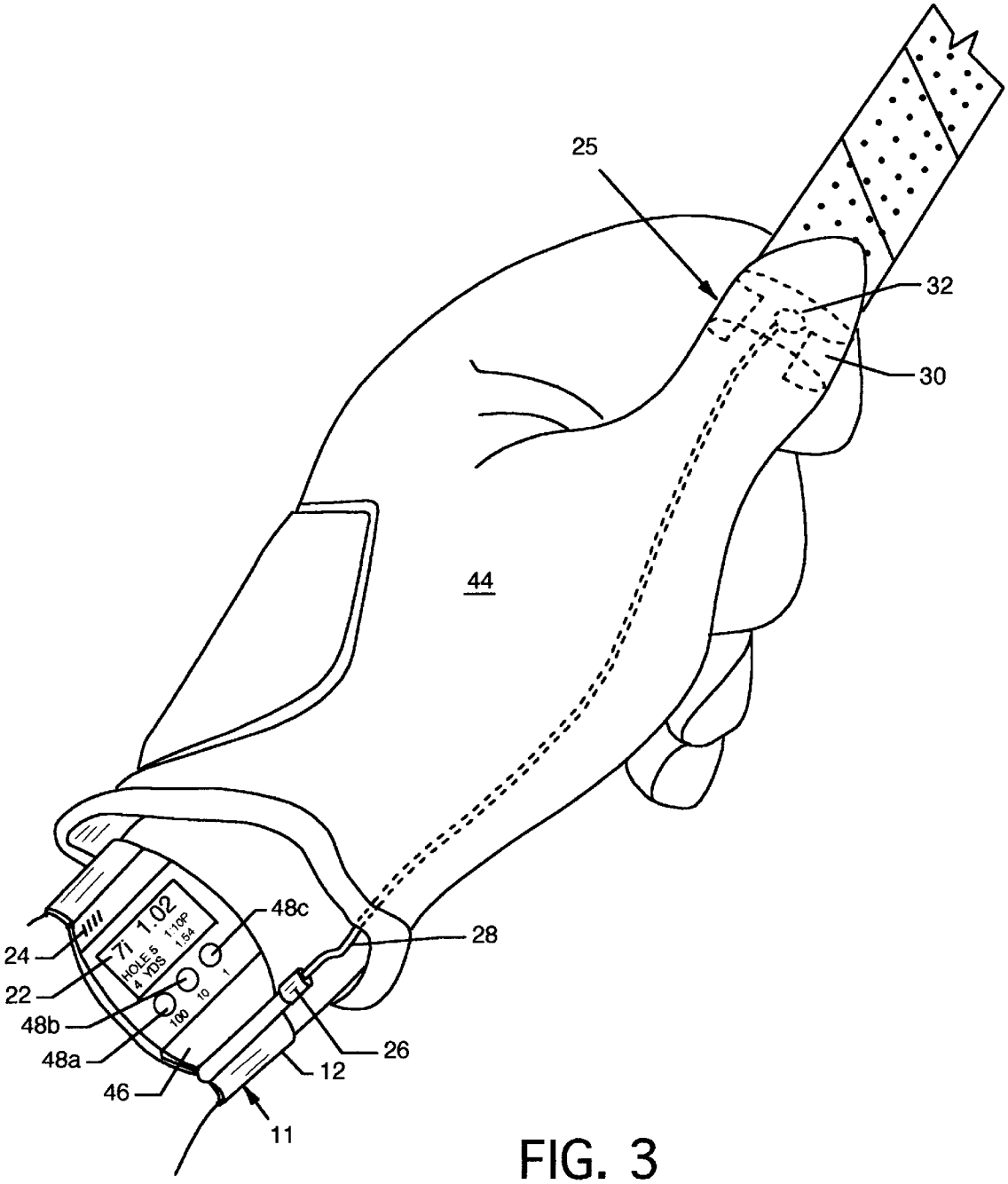
FIG. 3 illustrates a perspective view of the electronic golf swing timer in use.

FIG. 3 illustrates a perspective view of the electronic golf swing timer 10 appropriately worn by a player, where all numerals correspond to those elements previously described. The watch-like assembly 11 is appropriately secured to the player's wrist by wrist band 12, and the sensor assembly 25 is appropriately secured to the player's thumb by thumb clip 30 which contains membrane switch 32 and lead wire 28 which is connected by electrical connector 26 to the watch-like assembly 11 as shown on FIG. 3. A golf glove 44 is then worn over the sensor assembly 25 to prevent accidental removal during the swing. After the player has set the electronic golf swing timer 10 for each club as described in FIG. 1, the player selects the club he/she feels is the appropriate club for each shot's yardage, depresses the membrane switch 32 with the thumb at the beginning of the back swing, then the electronic golf swing timer 10 will audibly alert the player by a beep or like sound from speaker 24 when contact should be made with the ball. If the electronic golf swing timer 10 beeps before contact with the ball is made, the player must speed up his/her swing to hit the ball at the optimal time. If the electronic golf swing timer 10 beeps after contact with the ball is made, the player must slow down his/her swing to hit the ball at the optimal time.

Various modifications can be made to the present invention without departing from the apparent scope hereof.

ELECTRONIC GOLF SWING TIMER

PARTS LIST

10 electronic golf swing timer
11 watch-like assembly
12 wrist band
14 casing
16 club button actuator
18 time button actuator
20 set button actuator
22 LCD display
24 speaker
25 sensor assembly
26 electrical connector
28 lead wire
30 thumb clip
32 membrane switch
34 club display
36 timer display
38 yardage display
40 time display
42 hole number display
44 golf glove
46 hinged button cover
48*a*–*c* yardage selector buttons

I claim:

1. The process of timing a golf swing comprising of the steps of:

a. setting a swing time for a particular golf club from backswing to contact with a golf ball by pressing a club button followed by a time button followed by a set button located on a watch-like assembly;

b. pushing a club button located on said watch-like assembly representative of the golf club to be swung;

c. observing an LED display on said watch-like assembly indicating the golf club chosen and the swing time for the golf club;

d. activating a membrane switch positioned conveniently on a finger clip remote from said watch-like assembly to generate an electrical connection to indicate the start of the backswing;

e. transmitting said electrical connection via a lead wire to said watch-like assembly to initiate a timer; and, f. providing an audible beep from said watch-like assembly after the swing time has elapsed as notification that contact of the golf club with the golf ball should ideally occur.

2. The process of claim 1, wherein the swing time is set for a plurality of golf clubs.

3. The process of claim 1, wherein a club button is pushed followed by a yardage button followed by a set button to lock in a typical golf club yardage for each of the plurality of golf clubs, said buttons all being located on said watch-like assembly.

4. The process of claim 3, further including the step of observing an LED display on said watch-like assembly to obtain information that was previously set, such information including the golf club chosen, the yardage for the chosen club, and the swing time for the chosen club.

5. The process of claim 4, further including the step of observing said LED display on said watch-like assembly to gain information regarding the time of day.

6. The process of claim 4, further including the steps of:

a. setting an amount of time that is being allowed to play 18 holes of golf by pressing the set button on the watch-like assembly; and, b. observing the LED display on the watch-like assembly indicating a particular hole representative on average of the hole to be played in order to finish 18 holes of golf in the time that is being allowed.

* * * * *